US005079917A

United States Patent [19]

Henkel

[11] Patent Number: 5,079,917

[45] Date of Patent: Jan. 14, 1992

[54] METHOD AND DEVICE FOR REGENERATING A SOOT FILTER OF A DIESEL COMBUSTION ENGINE

[75] Inventor: Dietmar Henkel, Neumarkt, Fed. Rep. of Germany

[73] Assignee: MAN Nutzfahrzeuge AG, Munich, Fed. Rep. of Germany

[21] Appl. No.: 628,387

[22] Filed: Dec. 14, 1990

[30] Foreign Application Priority Data

Dec. 16, 1989 [DE] Fed. Rep. of Germany ..... 3941635

[51] Int. Cl.[5] ..... F01N 3/02

[52] U.S. Cl. ..... 60/274; 60/275; 60/295; 60/303; 60/312

[58] Field of Search ..... 60/275, 295, 303, 312, 60/274

[56] References Cited

U.S. PATENT DOCUMENTS 3,631,792 1/1972 Bodine ..... 60/312

4,923,033 5/1990 Panick ..... 181/258

FOREIGN PATENT DOCUMENTS 3818158 12/1989 Fed. Rep. of Germany .

184917 9/1985 Japan ..... 60/288

*Primary Examiner*—Douglas Hart

*Attorney, Agent, or Firm*—Robert W. Becker & Associates

[57] ABSTRACT

The invention relates to a method for regenerating a soot filter of a Diesel combustion engine. For the burning of soot deposited on the filter two coupled Helmholtz resonators are provided with the exhaust gases being introduced into the resonance pipes at their center portion. The timed ignition of the burners generates pressure waves in the system which may oscillate. When the top of a pressure wave is reached in one of the resonance housings, the temperature rises due to the adiabatic compression process such that the soot is ignited in the down-stream filter. Thereby the filter is regenerated due to the burning of soot. The burners are ignited in phase opposition so that the pressure waves generated by the burners are eliminated by interference at the location of the opening of the exhaust gas line into the resonance pipes. An increase of the counter pressure in the exhaust gas line due to negative feedback of the pressure waves is thereby prevented.

8 Claims, 2 Drawing Sheets

METHOD AND DEVICE FOR REGENERATING A SOOT FILTER OF A DIESEL COMBUSTION ENGINE

BACKGROUND OF THE INVENTION

The present invention relates to a method for regenerating a soot filter of a Diesel combustion engine in which the exhaust gases are introduced into a first and second coupled Helmholtz resonators, having respective first and second resonance containers, such that the ignition temperature of the soot is exceeded by periodic adiabatic compression of the oscillating exhaust column, actuated by igniting a first burner of a first one of the Helmholtz resonators which is timed in intervals corresponding to the resonance frequency, and a filter, arranged down-stream of a first one of the resonance housings, is regenerated by burning of the soot.

It is known from DE-OS 38 18 158 to introduce exhaust gases from Diesel combustion engines into two coupled Helmholtz resonators. The exhaust gases are fed into the resonators via the face of a first resonator. The first resonator is coupled with the second resonator via a resonance pipe. After passing the two resonators and the resonance pipe the exhaust gases reach a soot filter in which the Diesel soot is separated. In order to regenerate the soot filter, the second resonator, which is arranged directly before the soot filter, is equipped with a burner which may be operated in timed intervals. When the counter pressure in the resonator increases due to soot deposits, the burner is actuated periodically. The burner is ignited by a high voltage spark plug so that the exhaust gases inside the Helmholtz resonator are excited to carry out resonance oscillations. When after a pressure reduction a pressure build-up occurs again in the second resonator, an adiabatic compression of the exhaust gases occurs resulting in a temperature increase which is sufficient to ignite the soot at the neighboring filter thereby burning and destroying the soot deposit. A disadvantage of such a device is that the combustion engine is adversely affected by the first resonator because the pressure increase in the first resonator also increase the counter pressure in the exhaust line resulting in a power loss and an efficiency decrease of the combustion engine. By installing self-closing flap valves into the exhaust line, the negative feedback of the first resonator may be reduced, but due to the back pressure of the exhaust gases at the periodically closed flap valve the counter pressure is also increased causing the same negative feedbacks.

According to DE-OS 29 30 969 it is suggested to install a flap valve into the exhaust pipe after the filter which may be closed periodically for a short time so that the exhaust gases are stowed and compressed. Thus, the soot separated in the filter may be ignited and burned due to the temperature increase resulting from the compression. The disadvantage of such a device is that the flap valve also increases the counter pressure, thereby decreasing the effective power and the efficiency of the combustion engine.

It is therefore an object of the present invention to improve the method of the aforementioned prior art such that an effect of the regenerating system on the combustion engine is prevented without adversely affecting the quality of the regenerating process.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
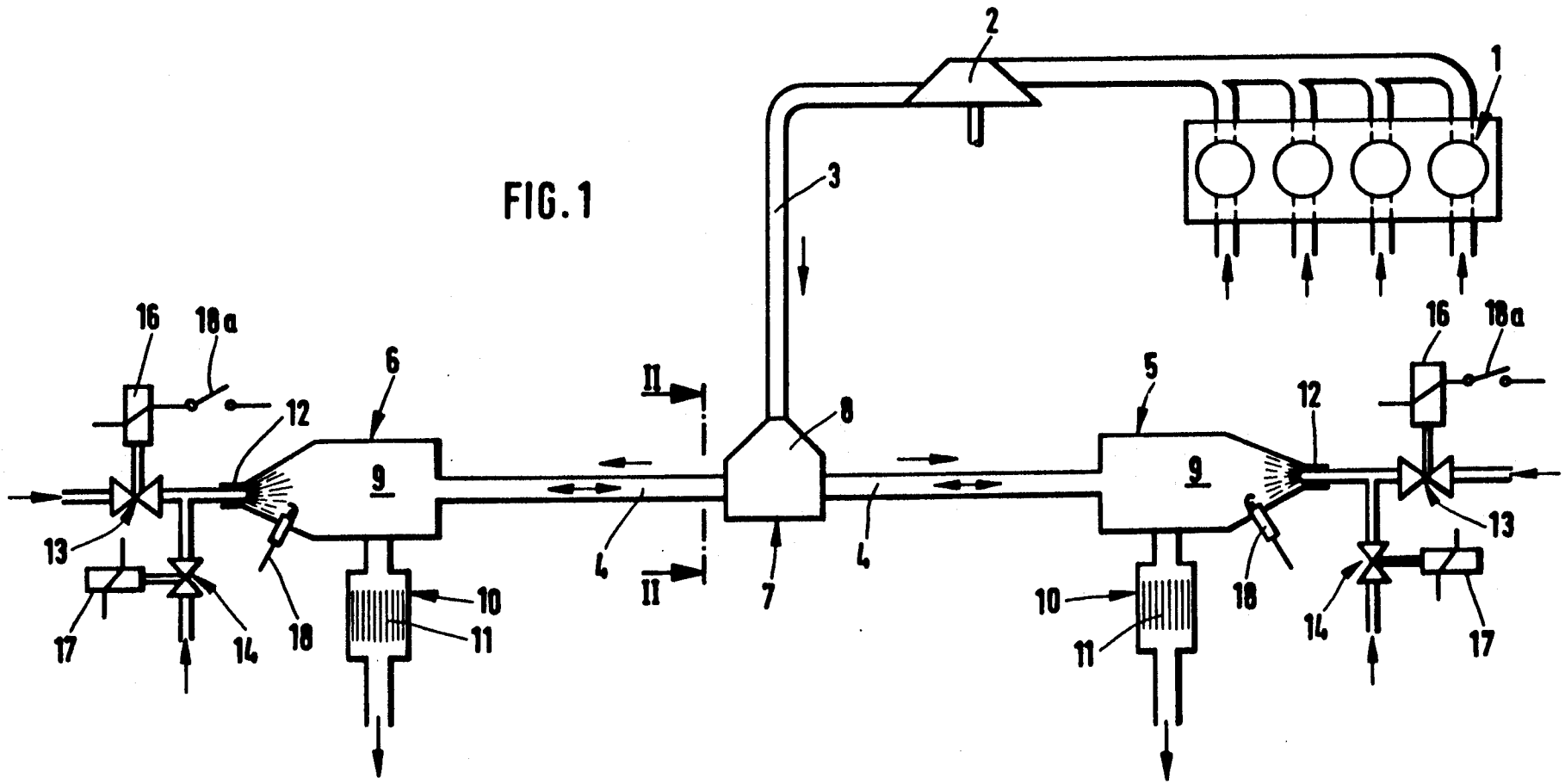
FIG. 1 is a schematic drawing of the path of the exhaust gases with a double Helmholtz resonator having integrated burners with down-stream soot filters.

The method of the present invention is primarily characterized by feeding the exhaust gases via an exhaust gas line arranged in a symmetry plane between a first and a second Helmholtz resonator into respective resonance pipes whereby the second resonator is equipped with a second burner with the second and the first burner being ignited in phase opposition and with the resonance oscillations in the respective resonance housings effecting the identical pressure values with reversed signs, with the timing intervals of the first and second burners corresponding to the individual oscillation periods of the coupled first and second Helmholtz resonators with the resonance frequency at the highest exhaust gas temperature being smaller than 0.7 times the lowest ignition frequency of the Diesel combustion engine, and with a negative feedback of the Helmholtz resonators on the exhaust gas line being eliminated by the interference effects, due to the distribution of the exhaust gas stream into the first and second Helmholtz resonators.

Due to the second burner being operated in phase intervals to the first burner, the pressure waves, induced by the timed burners in the resonance pipes between the two resonators, is eliminated due to interference effects, so that a negative feedback on the exhaust gas line which opens into the resonance pipes at their center position is prevented. The burners timed at the resonance frequency cause the exhaust gases to undergo pulsating adiabatic compression. The resulting intermittent temperature increase causes the burning of the soot in the neighboring soot filters thereby regenerating the soot filters.

An advantageous embodiment of the present invention is characterized by introducing the same amount of fuel into the burners of the resonance housings, with the distribution of the exhaust gases being achieved by a key relationship control. This is necessary in order to ascertain the elimination of the pressure waves, due to interference induced by the burners.

An advantageous method for assuring a long life span of the high voltage spark plug is characterized by switching the high voltage spark plugs such that they are out of phase with the atomization process of the burner and are switched on for the period of the soot removal so that the long phase of the spark generation is used for the soot burning at the insulator surface of the spark plug.

A device for regenerating a soot filter of a Diesel combustion engine is primarily characterized by a second Helmholtz resonator being identical to the first Helmholtz resonator, both having a respective resonance housing, a respective soot filter 10 with a respective filter portion 11, and a respective burner 12 equipped with a respective fuel valve 13 and a respective air valve 14 that are actuated by electromagnets 16, 17, and a respective high frequency spark plug 18. The two identical Helmholtz resonators are equipped with respective resonance pipes 4 that are connected to an exhaust gas line 3 in a symmetrical arrangement.

Due to the identical resonance housings with the burners the complete elimination of the pressure waves in the middle of the resonance pipe is ascertained. Since the exhaust gases are introduced at the location where the pressure waves are eliminated by interference the negative feedback on the exhaust gas line and the combustion engine are reliably prevented.

Another preferred embodiment of the present invention is characterized by the soot filter having a filter portion being coaxially arranged inside the resonance housings, with the resonance pipe opening into a face of the resonance housing whereby the transition of the resonance pipe to the resonance housing is formed as a diffusor.

By installing the soot filter inside the resonance housing, an intensive contact of the adiabatically heated exhaust gases with the soot laden filter surface is achieved. Also, the heat losses are noticeably reduced because the heat exchanging surface is reduced, whereby, due to the higher temperature inside the resonance housing, the right conditions for an efficient burning of the soot is achieved.

In a further embodiment, the exhaust gas line opens tangentially into a casing, whereby a transition of the exhaust gas line to the casing is formed as a first diffusor and the resonance pipes are enclosed in a centered manner by the casing.

By introducing the exhaust gases tangentially into the resonance pipes and due to the diffusor-like design of the casing, the kinetic energy of the exhaust gases is transformed with minimum losses into the static pressure energy. This may be used for a further adiabatic temperature increase without simultaneously increasing the counter pressure in the exhaust gas line.

DESCRIPTION OF PREFERRED EMBODIMENTS

The present invention will now be described in detail with the aid of several specific embodiments utilizing FIGS. 1 through 3.

FIG. 1 represents a schematic drawing of the path of the exhaust gases of a Diesel combustion engine. In the present example, the exhaust gases leaving the combustion engine 1 are introduced via an exhaust gas turbine 2 and an exhaust gas line 3 into the resonance pipes 4 of an oscillating system comprising two Helmholtz resonators 5, 6. The identical Helmholtz resonators 5 and 6 are arranged symmetrically relative to the exhaust gas line 3. Due to the identical design of the two Helmholtz resonators, the parts represented in FIG. 1 are identified by the same numerals. The exhaust gases from the exhaust gas line 3 first pass through a casing 7 which coaxially encloses the resonance pipes 4. In order to convert the kinetic energy of the exhaust gases into potential pressure energy with high efficiency, the casing is provided with a first diffusor 8 in the transition zone.

The Helmholtz resonators 5, 6, in a known manner, comprise a resonance pipe 4 and a resonance housing 9 with the resonance pipe 4 coaxially opening into the face of the resonance housing g Down-stream from the resonance housing 9 there is provided a soot filter 10 having a filter portion 11 disposed therein. The resonance housing 9 is equipped with a burner 12 which is supplied with fuel via a fuel valve 13. The fuel valve 13 is intermittently timed according to the resonance frequency of the Helmholtz resonators. The air supply of the fuel valve 13 is controlled by an air valve 14. Both valves are electronically controlled. Preferably, both valves are actuated by electromagnets 16 and 17. The ignition of the injected fuel is achieved by a high voltage spark plug 18, which is arranged in the jet zone of the burner 12.

In the following paragraphs the mode of operation will be further explained.

The exhaust gas stream coming from the combustion engine 1 is distributed to the equal-length resonance pipes 4 inside the casing 7. Via the resonance pipes 4 and the resonance housings 9 the soot laden exhaust gas stream is introduced into the soot filer 10, which contain the filter portions 11 which separate the soot from the exhaust gas stream. Due to the soot deposits in the soot filter 10, the flow resistance is increased so that the counter pressure in the exhaust gas line 3 is increased. Via a pressure measuring device, which is not represented in the drawing, the pressure increase is measured and a control signal is sent which activates the system for burning the soot deposited in the filter portions 11. This may be achieved with an electronic control which shall not be discussed in further detail herein.

In contrast to the prior art, two intermittently working burners 12 are inventively provided which are timed in phase opposition instead of one burner. Working in phase opposition means that the sine-shaped pressure wave phases are shifted by 180° relative to one another within the resonance housings 9. This allows for the realization of equivalent top values of the changing container pressures. A pre-requisite is that the resonance pipes 4 are of equal length and that the quantity of fuel allocated to the burners 12 for each single cycle are also identical. The latter may be easily realized by employing known electronically controlled key relationship controls for the electromagnets 16 via electronic switches 18*a*. A correct phase triggering of the start of the atomization process actuated by the switches 18*a* may be deduced in a known manner from the pressure increase in the respective resonance housing 9. The ignition of the fuel-air mixture is realized with the two high voltage spark plugs 18 (operational frequency between 50 and 100 Hz) which are activated during the soot burning phase. A synchronization of the ignition voltage of the spark plugs 18 according to the correct phase is not employed. However, the spark plugs remain in their activated state during the removal process, in order to make use of the long phase of the ignition spark generation for the purpose of soot burning at the surface of the spark plug (securing the electric readiness). The activation of the air valve 14 which releases the air for the atomization process should be maintained during the operation of the engine for the purpose of cleaning and cooling the fuel valve 12.

The geometric dimensions of the resonance housing 9 and the resonance pipes 4 should be selected such that, considering the highest speed of sound in the exhaust gases (at full load of the engine), the resonance frequency has a value of not greater than 0.7 times the lowest ignition frequency (lower idling engine revolutions). Thereby the changing pressures of the exhaust gases are not able to induce resonance in the resonator.

They are, to the contrary, suppressed in a desirable manner.

Forcing the top values of the pressure in the resonance housings 9 to be of a same value (as mentioned above) serve the purpose of, in the area of the casing 7, canceling the changing resonance pressures resulting from the intermittent operation of the burners 12 (which means: sign reversal and identical values of the two pressures at any time). Thereby it is assured that, in the area of the casing 7, only the kinetic energy component of the resonators 5 and 6 in the form of a sine-shaped modulated volume stream prevails. This means also, that even under highest changing pressures in the resonance housings 9 no negative feedback of those changing pressure on the exhaust gas line 3 and the load change of the combustion engine 1 are possible.

Figure 2:
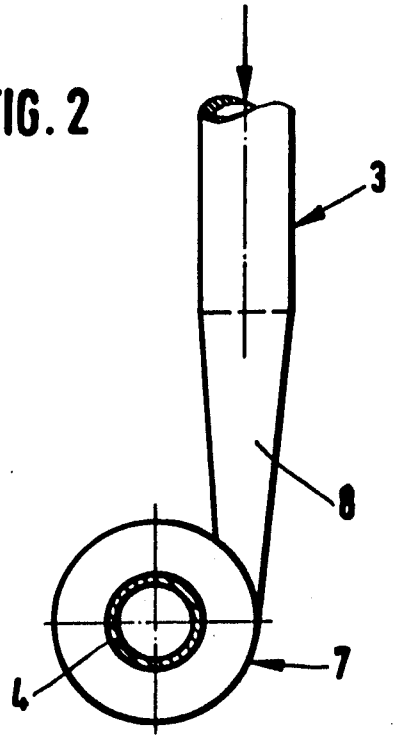
FIG. 2 shows a casing for introducing exhaust gases without losses into the resonance pipe.

A detailed view along the line II—II in FIG. 1 is represented in FIG. 2. The resonance tune 4 is enclosed concentrically by the casing 7. The exhaust gases are blown via the diffusor 8 and the exhaust gas line 3 into the casing 7 in a tangentially manner. Due to the diffusor 8 and the tangentially blowing process, the kinetic energy of the exhaust gases is transformed at a minimum loss into the potential pressure energy.

Figure 3:
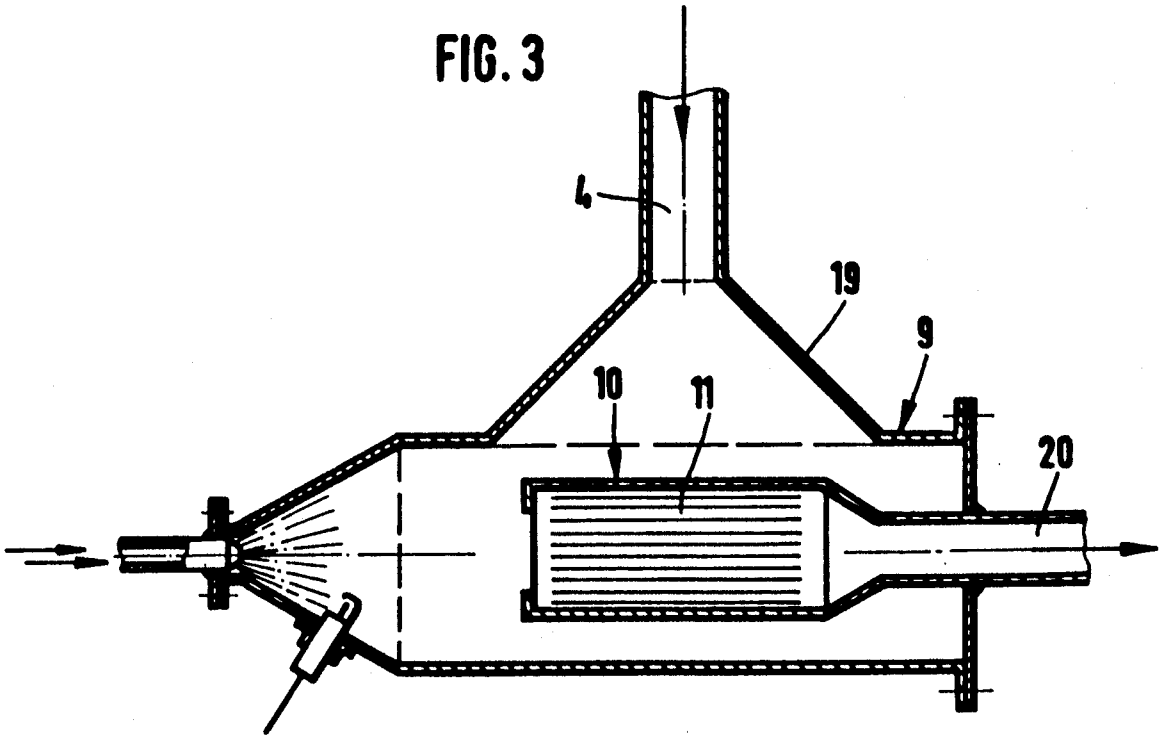
FIG. 3 represents an alternative solution for arranging the soot filter relative to the resonance housing.

A preferred arrangement of the filter portion 11, disposed directly inside the resonance housing 9, is represented in FIG. 3. The filter portion 11 is coaxially arranged inside the resonance housing 9. The exhaust gases are introduced via the resonance pipe 4 as shown in FIG. 1.

In FIG. 3 only one of the resonance housings 9 is represented due to the symmetrical arrangement. The exhaust gases coming from the resonance pipe 4 are introduced into a face of the resonance housing 9 via a further diffusor 19. The diffusor serves the purpose of transforming at minimum losses the kinetic energy in potential pressure energy. Via the exhaust pipe 20 the soot-free exhaust gases are discharged. Due to the arrangement of the filter portion 11 inside the resonance housing 9, the contact between the high temperature exhaust gases with the filter portion 11 is very intensive and no unnecessary heat losses occur at the walls of the soot filter 10, as observed accordingly in the embodiment of FIG. 1. Thus, the best conditions for the regeneration of the filter portion 11 are set.

The present invention is, of course, in no way restricted to the specific disclosure of the specification, examples and drawings, but also encompasses any modifications within the scope of the appended claims.

What is claimed is:

1. In a method for regenerating a soot filter of a Diesel combustion engine in which exhaust gases are introduced into a first and a second coupled Helmholtz resonator, having respective first and second resonance housings, such that an ignition temperature of soot is exceeded by periodic adiabatic compression of an oscillating exhaust column, actuated by igniting a first burner of said first Helmholtz resonator which is timed in intervals corresponding to a resonance frequency, and a filter arranged downstream of said resonance housing of said first Helmholtz resonator is regenerated by burning of soot, the improvement comprising the steps of:

feeding exhaust gases via an exhaust gas line, arranged in a symmetry plane between said first and second Helmholtz resonator, into respective resonance pipes;

equipping said second resonator with a second burner; and igniting said second burner and said first burner in phase opposition, with resonance oscillations in said respective resonance housings effecting identical, reversed sign pressure values, with timing intervals of said first and second burners corresponding to individual oscillation periods of said coupled first and second Helmholtz resonators, with a resonance frequency at a highest exhaust gas temperature being smaller than 0.7 times a lowest ignition frequency of said Diesel combustion engine, and with negative feedback of said Helmholtz resonators on said exhaust gas line being eliminated by interference effects due to a distribution of an exhaust gas stream into said first and second Helmholtz resonators.

2. A method according to claim 1, which includes the step of introducing a same amount of fuel into said burners of said resonance housings, with the distribution of fuel being achieved by a known key relationship control.

3. A method according to claim 1, which includes the step of switching high voltage spark plugs such that they are out of phase with an atomization process of said burners and are switched on for a period of soot removal so that a long phase of spark generation is used for soot burning at an insulator surface of said spark plugs.

4. A device for regenerating a soot filter of a Diesel combustion engine having an exhaust gas line and two coupled Helmholtz resonators, comprising:

a first one of said Helmholtz resonators including a first resonance housing, a first soot filter with a first filter portion, and a first burner equipped with a first fuel valve and a first air valve that are actuated by electromagnets, and a first high frequency spark plug;

a second one of said Helmholtz resonators including a second resonance housing, a second soot filter with a second filter portion, and a second burner equipped with a second fuel valve and a second air valve that are actuated by electromagnets, and a second high frequency spark plug;

with said two Helmholtz resonators being equipped with first and second resonance pipes that are connected to said exhaust gas line in a symmetrical arrangement.

5. A device according to claim 4, in which a same amount of fuel is introduced into said burners of said resonance housings, with the distribution of fuel being achieved by a known key relationship control.

6. A device according to claim 4, in which high voltage spark plugs are switched such that they are out of phase with an atomization process of said burners and are switched on for a period of soot removal so that a long phase of spark generation is used for soot burning at an insulator surface of said spark plug.

7. A device according to claim 4, in which said soot filters have respective filter portions coaxially arranged inside said respective resonance housings, with said resonance pipe opening into a face of said resonance housing whereby a transition of said resonance pipe to said resonance housing 9 is formed as a diffusor.

8. A device according to claim 7, in which said exhaust gas line opens tangentially into a casing, with a transition of said exhaust gas line to a casing being formed as a further diffusor and with said the resonance pipes being enclosed in a centered manner by said casing.

* * * * *